United States Patent [19]

Nourbakhsh

[11] Patent Number: 4,596,058

[45] Date of Patent: Jun. 24, 1986

[54] BIDET ATTACHMENT FOR WATER CLOSETS

[76] Inventor: Mahmoud M. Nourbakhsh, 4032 NW. Claymont Dr., Kansas City, Mo. 64116

[21] Appl. No.: 744,019

[22] Filed: Jun. 12, 1985

[51] Int. Cl.[4] ..... A61H 35/00

[52] U.S. Cl. ..... 4/448; 4/420.1; 4/420.2; 4/420.4; 4/443; 128/66

[58] Field of Search ..... 4/443, 448, 447, 420.1, 4/420.2, 420.3, 420.4, 420.5; 128/66

[56] References Cited

U.S. PATENT DOCUMENTS

| | | | |
|---|---|---|---|
| 2,075,830 | 4/1937 | Salvoni | 4/420.3 |
| 2,364,491 | 12/1944 | Triadou | 4/420.4 X |
| 3,386,105 | 6/1968 | Martini | 4/420.4 |
| 3,430,267 | 3/1969 | Van Houten | 4/420.4 X |
| 3,430,268 | 3/1969 | Zoberg | 4/420.1 |
| 4,145,767 | 3/1979 | Ibel | 4/420.3 |
| 4,326,630 | 4/1982 | Silver | 4/420.4 |
| 4,510,630 | 4/1985 | Osgood | 4/443 |

*Primary Examiner*—Henry K. Artis

*Attorney, Agent, or Firm*—Kokjer, Kircher, Bradley, Wharton, Bowman & Johnson

[57] ABSTRACT

A bidet attachment for a conventional water closet. An open compartment is formed at one end of the water tank to receive a water mixing chamber which receives water from incoming hot and cold supply lines. The entry of hot and cold water into the mixing chamber is controlled by valve control handles on the side of the compartment. An outlet pipe extends from the mixing chamber to the overfill pipe of the water tank and is accesible so that the water temperature can be sensed by touching the outlet pipe. A hand held spray is carried on the end of a flexible hose which can be retracted into the compartment for storage. A control button on the spray head can be activated to divert water from the outlet pipe to the hose for application of a bidet spray from the spray head, with the toilet bowl serving as the bidet basin.

20 Claims, 3 Drawing Figures

BIDET ATTACHMENT FOR WATER CLOSETS

BACKGROUND OF THE INVENTION

This invention relates in general to bidets and more particularly to a bidet arrangement which is combined with a water closet and which makes use of the toilet bowl as a bidet basin.

As exemplified by U.S. Pat. No. 2,075,830 to Salvoni and U.S. Pat. No. 4,145,767 to Ibel, attempts have been made in the past to combine a bidet with a water closet. However, these attempts have not resulted in commercially successful units for a number of reasons, mostly relating to lack of practicality. Both devices require the addition to the toilet bowl of a separate bidet basin which is hinged so that it can be raised and lowered. The need for a separate bidet basin adds to the cost of the device and requires that the bidet basin be stored when not in use. Provision must also be made for draining the bidet basin after its use, and problems relating to hygiene are encountered.

Another significant problem with arrangements of this nature is that the bidet spray is built into the basin and thus originates from a fixed location. Consequently, the bidet spray cannot be directed at a particular location and cannot be redirected if desired. Additionally, special water closet structures are required, and this increases the expense and makes it impractical to add the bidet arrangement to an existing water closet of conventional construction.

Other types of water closet-bidet systems are shown in U.S. Pat. No. 3,430,268 to Zoberg and U.S. Pat. No. 4,326,308 to Silver. Although these devices take advantage of the toilet bowl for use as the bidet basin, they are subject to a number of shortcomings in other respects. Again, the bidet spray is in fixed location in the toilet bowl, and this leads to hygiene problems and problems in the inability to redirect the spray. Water for the bidet spray is supplied from a faucet, and this type of device is not operable unless there is a faucet situated nearby at a convenient location. Even then, the need to connect the bidet spray hose to the faucet each time it is to be used and then to disconnect it after use is an awkward procedure which results in considerable inconvenience and deters persons from using the bidet.

SUMMARY OF THE INVENTION

The present invention provides a unique arrangement for combining a bidet with a water closet in a manner which permits both the toilet and bidet to be conveniently used. In accordance with the invention, an open bottomed compartment is either added to one side of an existing water closet tank or is built into the tank as an original part of the water closet. In either case, the compartment is used to conceal a water mixing chamber which is supplied with hot and cold water through incoming supply lines. Conventional faucet handles are mounted on the side of the compartment at a location where they are conveniently accessible for adjustment of the water temperature.

An outlet pipe extends from the mixing chamber to the overfill pipe in the tank in order to direct the water to the overfill pipe. It is an important feature of the invention that a portion of the outlet pipe extends along the side of the compartment at a conveniently accessible location so that the outlet pipe can be touched to sense when the water is at the desired temperature for the bidet spray. A hand held spray head is carried on the end of a flexible hose which retracts into the compartment for storage. The hose can be extended out of the compartment when the spray head is to be used to apply a bidet spray. A hand operated control on the spray head can be activated to cause water in the mixing chamber to be diverted from the outlet pipe to the flexible hose and through the hose to the spray head.

A particularly important advantage of the bidet arrangement of the present invention is that it can be constructed from readily available parts so that its cost is reduced in comparison to more complicated devices which require special toilet bowls, special water tanks or other specialized components. Installation is also easily carried out and does not require special skills or special tools or other equipment. The only plumbing alterations that are required are the addition of an incoming hot water line and a cold water tap line. The added compartment and other components do not detract appreciably from the appearance of the water closet. The unit also occupies little space, which is often at a premium in crowded bathroom areas. The accessibility of the outlet pipe permits the water temperature to be sensed by touch and easily adjusted to the desired level for the bidet spray. The hand held spray head can be directed at any desired area or areas which are to be washed. There are no components mounted in the toilet bowl or on the seat, and the bidet can thus be used in a hygienic manner.

The above functional features may be totally obtained by using only one hand. Thus, handicapped or disabled users have free access to my invention. For example, only one hand is needed to turn on the water, check the temperature, properly position the hose and activate the spray head.

DETAILED DESCRIPTION OF THE INVENTION

In the accompanying drawing which forms a part of the specification and is to be read in conjunction therewith and in which like reference numerals are used to indicate like parts in the various views.

Figure 1:
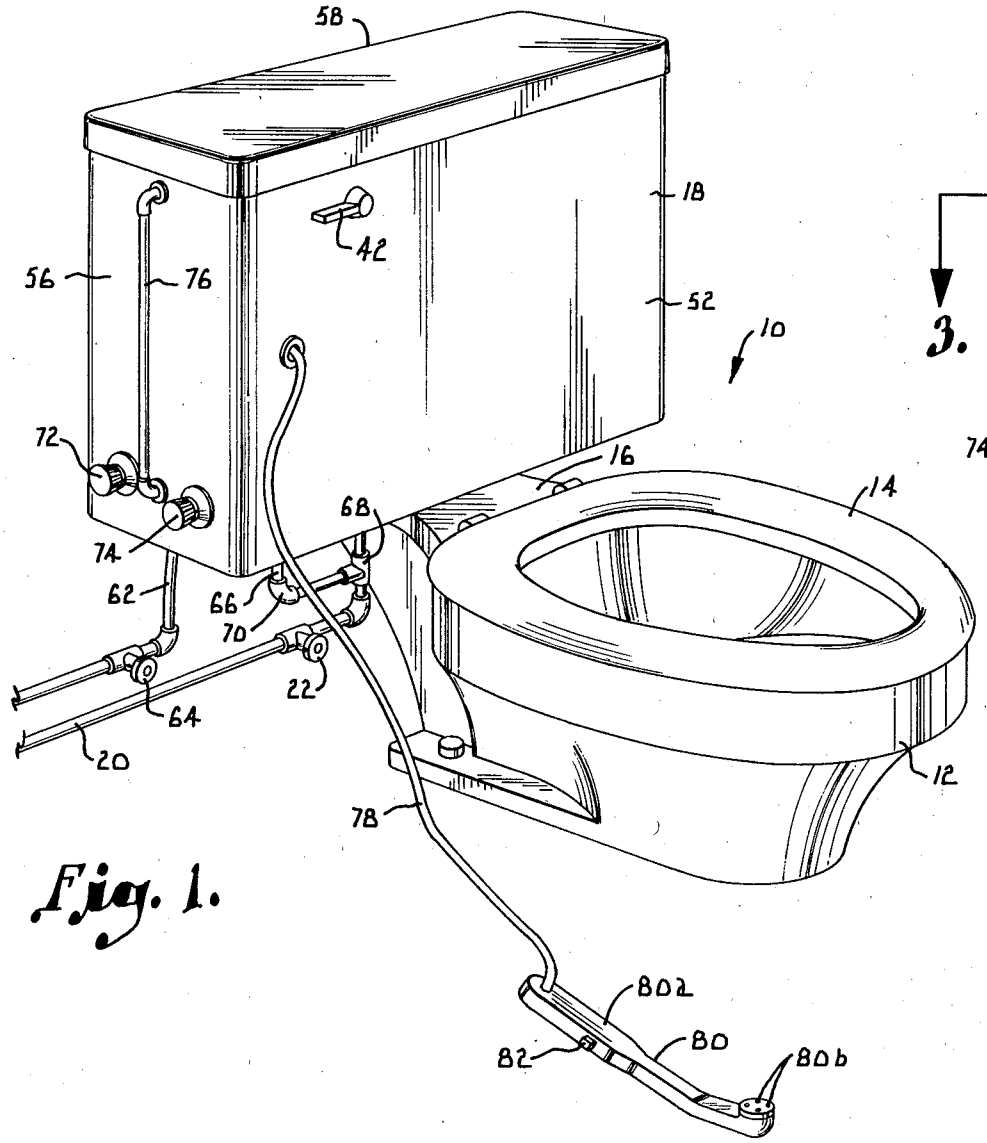
FIG. 1 is a perspective view showing a water closet combined with a bidet arrangement constructed according to a preferred embodiment of the present invention, with the flexible bidet spray hose in its extended condition.

Referring now to the drawing in more detail and initially to FIG. 1, numeral 10 generally designates a water closet or toilet assembly which is constructed in a conventional manner for the most part. A toilet bowl 12 of the usual construction is provided with a hinged seat 14. Extending to the rear of the toilet bowl 12 is a stand 16 on which a rectangular water tank 18 is mounted. Incoming water is provided to the tank 18 through a cold water supply line 20 having a shut-off valve 22.

Figure 2:
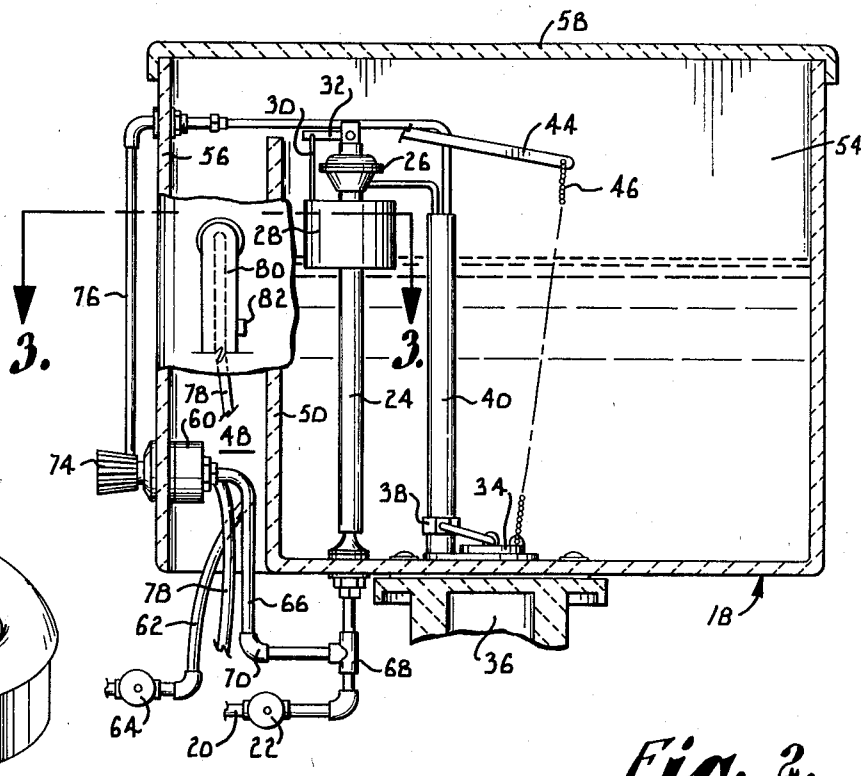
FIG. 2 is a fragmentary sectional view taken on a vertical plane through the water closet tank, with the flexible hose in its retracted storage condition.

Referring additionally to FIG. 2, the supply line 20 connects through the bottom of tank 18 with a vertical fill pipe having on its top end a valve 26 which controls the entry of water into the tank 18. A float cup 28 floats on the water in tank 18 and controls the condition of valve 26 through a pull rod 30 and a lever 32.

A flapper 34 controls the flow of water from the tank 18 into an inlet passage 36 for the bowl 12. The flapper 34 is pivoted to a collar 38 mounted on a vertical overflow pipe 40 having its open top end located above the normal level of the water in the tank 18. A flush handle 42 (FIG. 1) can be activated to open the flapper 34 through a trip lever 44 and a chain 46 which extends between the trip lever and flapper.

As thus far described, the components of the water closet are conventional.

In accordance with the present invention, an open compartment 48 is formed on one side of the tank 18. An internal partition 50 separates the water tank from the compartment 48, and the tank and compartment have a common front wall 52 and a common rear wall 54. The compartment 48 is open at the bottom and has a wall 56 which forms one side wall of the tank assembly. A common lid 58 covers the top of the water tank 18 and compartment 48 and may be removed to provide access to the internal components.

A box-like water mixing chamber 60 is mounted within compartment 48 to the inside surface of wall 56. The mixing chamber 60 receives hot water from a hot water supply line 62 which extends into chamber 48 through its open bottom and may be equipped with a shut-off valve 64. The hot water supply line 62 is an added line that may be tapped into an existing hot water line.

Cold water is supplied to chamber 60 through a cold water line 66 which is preferably tapped into line 20. A T-fitting 68 may be installed in line 20 at a location downstream from the shut-off valve 22. Line 66 extends from the T-fitting 68 and includes an elbow 70. Line 66 extends through the open bottom of compartment 48 and connects with the mixing chamber 60 at a location offset from the point of connection of the hot water line 62.

Figure 3:
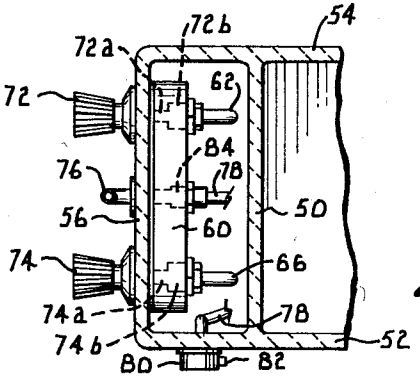
FIG. 3 is a fragmentary sectional view taken generally along line 3—3 of FIG. 2 in the direction of the arrows.

Control handles 72 and 74 are provided for controlling the flow of hot and cold water into the mixing chamber 60. The control handles are constructed and function in the manner of conventional faucet handles and are mounted on the outside surface of wall 56. As best shown in FIG. 3, the hot water control handle 72 has a stem **72*a* which carries a valve 72*b*. The valve 72*b* can be moved toward and away from its seat by turning of the handle 72. The cold water control handle 74 similarly has a stem 74*a* and a valve 74*b* which can be seated and unseated by rotation of handle 74**.

A metal outlet pipe 76 connects with the mixing chamber 60 and extends out of compartment 48 through the wall 56. The outlet pipe 76 extends upwardly along the outside surface of wall 56 and then extends back through wall 56 at a location slightly below the lid 58. As best shown in FIG. 2, the outlet pipe 76 extends above the partition 50 and is turned downwardly into the open top end of the overflow pipe 40. The portion of pipe 76 which is located outside of the compartment 48 and tank 18 is at a convenient location approximately midway between the two valve handles 72 and 74.

Also connected with the mixing chamber 60 is an elongate flexible hose 78. One end of hose 78 connects with the mixing chamber 60, and the hose extends out of compartment 48, through wall 52 and carries on its opposite or free end a hand held spray head 80. Hose 78 can be fully retracted into compartment 48 for storage, and in the stored position, the spray head 80 is located adjacent to the outside surface of the front wall 52, as shown in FIG. 2. The spray head can have a suitable hanger (not shown) or it can be hung in the manner shown in FIG. 2. Hose 78 can be extended out of compartment 48 and is long enough to permit the spray head 80 to easily reach the toilet bowl 12, as best shown in FIG. 1.

The spray head 80 has an elongate handle **80*a* and a plurality of adjustable spray openings 80*b* for spraying water which is supplied to the spray head through hose 78. A hand operated control button 82 is located on the side of handle 80*a*. When the button 82 is in the off position, a diverter valve 84 (see FIG. 3) closes hose 78 and permits all of the water in the mixing chamber 60 to discharge therefrom through the outlet pipe 76. When button 82 is pressed to the on position, the diverter valve diverts all of the water from chamber 68 into the flexible hose 78**. The operation of the diverter valve is well known and is similar to the diverter valves used in conventional kitchen faucets equipped with spray hoses. Accordingly, the device can be used as a bidet or as a direct spray to wash with the help of the other hand, if so desired.

In use of the bidet, the control handles 72 and 74 are turned to open the valves **72*b* and 74*b* to the desired extent. Hot and cold water is then applied to the mixing chamber 60 through lines 62 and 66, and the water is mixed in the mixing chamber and discharged through the outlet pipe 76. By grasping the outlet pipe 76, the water temperature can be sensed by touch and the control handles 72 and 74 can be adjusted until the water flowing through pipe 76 is at the temperature desired for the bidet. At this time, all of the water from chamber 60 is directed through the outlet pipe 76 and into the overflow pipe 40**.

Once the desired water temperature has been achieved, the spray head 80 is grasped in the hand and pulled in order to extend the hose 78. The spray head 80 is positioned to direct the bidet spray as desired, and the button 82 is depressed with the thumb to activate the spray. Then, the diverter valve 84 diverts all of the water away from the outlet pipe 76 and through the hose 78 to the spray head. A spray is then emitted through the spray openings **80*b*, and the bowl 12 serves as the bidet basin so a separate bidet fixture or basin is not required. The spray head control button 82** can be depressed and released as desired to activate and deactivate the bidet spray.

When the bidet spray has been completed, the control handles 72 and 74 can be tightened to close the valves **72*b* and 74*b*. This cuts off the incoming water to the mixing chamber 60. The hose 78 is retracted into compartment 48, and the spray head 80 is hung for storage on wall 52 in the position shown in FIG. 2**.

The bidet attachment can either be built directly into the water closet tank 18 in the manner shown, or the compartment 48 can be added to one side of an existing water tank. In either case, the added compartment is barely noticeable and does not significantly detract from the appearance of the water closet. Because the toilet bowl 12 is used as a bidet basin, there is no need to add a separate bidet fixture, and the added components occupy only minimal space. The only plumbing required is the addition of the hot water line 62 and the installation of the cold water tap line 66.

It is a particular feature of the bidet attachment that the spray head 80 is located outside of the bowl 12 and is a hand held unit which can be applied to any area which is to be washed. The water temperature can be adjusted as desired and sensed simply by touching the readily accessible outlet pipe 76.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A bidet arrangement for cooperation with a toilet assembly having a bowl and water tank, said bidet arrangement comprising:

means for providing a substantially enclosed compartment on one side of the tank;

a water mixing chamber mounted in said compartment;

hot and cold water supply lines connected with said mixing chamber to supply hot and cold water thereto;

valve means for controlling the relative proportions of hot and cold water entering said mixing chamber from the supply lines, thereby controlling the temperature of the water in the mixing chamber;

control handle means on said compartment at an accessible location for controlling said valve means;

an outlet pipe extending from said mixing chamber for normally discharging water therefrom;

a flexible hose communicating at one end with said mixing chamber and carrying a bidet spray head on the opposite end, said spray head being adapted to be held in the hand and said hose having a length to reach the toilet bowl so that the bowl can be used as a bidet basin; and control means for activating said spray head, said control means diverting water from said outlet pipe to said hose for applying a bidet spray through said spray head when the control means is operated.

2. The invention of claim 1, wherein said compartment has an open bottom and said supply lines extend through said open bottom to connection with said mixing chamber.

3. The invention of claim 1, wherein said compartment has an outside wall which presents inside and outside surfaces, said mixing chamber being mounted on said inside surface and said control handle means being mounted on said outside surface.

4. The invention of claim 3, wherein said outlet pipe has a portion extending generally along said outside surface at an accessible location to permit the temperature of the water in the outlet pipe to be sensed by touching said portion thereof.

5. The invention of claim 4, wherein the water tank has an overfill pipe therein and said outlet pipe leads into said overfill pipe to normally deliver water from the mixing chamber to the overfill pipe.

6. The invention of claim 1, wherein the water tank has an overfill pipe therein and said outlet pipe leads into said overfill pipe to normally deliver water from the mixing chamber to the overfill pipe.

7. The invention of claim 1, wherein said outlet pipe has a portion thereof extending outside of said compartment and tank at an accessible location to permit the temperature of the water in the outlet pipe to be sensed by touching said portion thereof.

8. The invention of claim 7, wherein the water tank has an overfill pipe therein and said outlet pipe leads into said overfill pipe to normally deliver water from the mixing chamber to the overfill pipe.

9. The invention of claim 1, wherein said hose has a retracted condition wherein the hose is retracted within said compartment and said spray head is located adjacent the compartment.

10. A bidet arrangement for use with a toilet assembly which includes a bowl and a water tank having an open top overflow pipe therein, said bidet arrangement comprising:

means for providing a substantially enclosed compartment on one side of the tank;

a water mixing chamber mounted in said compartment;

a cold water supply line connected with said mixing chamber to supply cold water thereto;

a hot water supply line connected with said mixing chamber to supply hot water thereto;

valve means for controlling the amounts of hot and cold water entering the mixing chamber to control the temperature of the water therein;

control handle means on the exterior of said compartment for controlling said valve means;

an outlet pipe connected with said mixing chamber at one end and with the overflow pipe at the other end for normally directing the water in the mixing chamber to the overflow pipe, said outlet pipe having a portion thereof extending exteriorly of said compartment and tank at an accessible location for sensing by touch the temperature of the water flowing therein;

a flexible hose connected at one end with said mixing chamber and carrying a bidet spray head on the opposite end, said hose being retractable into said compartment and being extensible out of said compartment to reach the toilet bowl with said spray head; and a control element on said spray head having a deactivated condition wherein the spray head is deactivated and an activated condition wherein water is diverted from said outlet pipe to said hose for application of a bidet spray through said spray head with the toilet bowl serving as a bidet basin for the spray.

11. The invention of claim 10, wherein said compartment has an open bottom and said supply lines extend through said open bottom to connection with said mixing chamber.

12. The invention of claim 10, wherein said compartment has an outside wall which presents inside and outside surfaces, said mixing chamber being mounted on said inside surface and said control handle means being mounted on said outside surface.

13. The invention of claim 12, wherein said portion of the outlet pipe is located adjacent said outside surface of the compartment wall.

14. A combination bidet and toilet comprising:

a toilet bowl;

a water tank for delivering water to said bowl, said tank having an open top overfill pipe therein;

a cold water supply line connected with said tank to supply water thereto;

an open compartment on one side of said tank;

a water mixing chamber mounted in said compartment for receiving and mixing hot and cold water;

a hot water line connected with said mixing chamber to supply hot water thereto;

a cold water tap line connected with said cold water supply line at one end and with said mixing chamber at the other end to supply cold water to the mixing chamber;

valve means for controlling the entry of hot and cold water into the mixing chamber;

control handle means mounted on said compartment and accessible from the exterior thereof for controlling said valve means to control the temperature of the water in said mixing chamber;

an outlet pipe connected at one end with said mixing chamber and having another end disposed in said overfill pipe to normally direct water from the mixing chamber to the overfill pipe, said outlet pipe having a portion thereof extending outside of the compartment and tank at an accessible location for sensing by touch the temperature of the water in the outlet pipe;

a flexible hose connected at one end with said mixing chamber and having an opposite end located outside of said compartment, said hose being retractable into said compartment and being extensible out of the compartment to permit said other end to reach the bowl;

a hand held bidet spray head on said opposite end of the hose operable to apply a bidet spray when water is applied thereto through said hose; and control means on said spray head operable when activated to divert water from said outlet pipe to said hose for application to said spray head, thereby providing a bidet spray at the temperature of the water in said mixing chamber and making use of the toilet bowl for service as a bidet basin for the spray.

15. The invention of claim 14, wherein said compartment has an open bottom and said supply lines extend through said open bottom to connection with said mixing chamber.

16. The invention of claim 14, wherein said compartment has an outside wall which presents inside and outside surfaces, said mixing chamber being mounted on said inside surface and said control handle means being mounted on said outside surface.

17. The invention of claim 16, wherein said portion of the outlet pipe is located adjacent said outside surface of the compartment wall.

18. The invention of claim 14, wherein said tank and compartment have a common front wall and an interior partition separates said compartment from the water contained in said tank.

19. The invention of claim 18, wherein said outlet pipe extends above said partition from said compartment into said tank.

20. The invention of claim 18, including a common lid for covering the compartment and tank.

* * * * *